US007198842B2

(12) United States Patent
Rancien et al.

(10) Patent No.: US 7,198,842 B2
(45) Date of Patent: Apr. 3, 2007

(54) SELF-ADHESIVE DATA CARRIER

(75) Inventors: Sandrine Rancien, La Murette (FR); Didier Gouelibo, Cernay la Ville (FR); Gilles Darnault, Rives (FR)

(73) Assignee: Arjo Wiggins Security SAS, Issy les Moulineaux (FR)

( * ) Notice: Subject to any disclaimer, the term of this patent is extended or adjusted under 35 U.S.C. 154(b) by 137 days.

(21) Appl. No.: 10/468,847

(22) PCT Filed: Dec. 27, 2002

(86) PCT No.: PCT/FR02/04573

§ 371 (c)(1),
(2), (4) Date: Sep. 29, 2003

(87) PCT Pub. No.: WO03/060856

PCT Pub. Date: Jul. 24, 2003

(65) Prior Publication Data

US 2004/0180168 A1 Sep. 16, 2004

(30) Foreign Application Priority Data

Jan. 3, 2002 (FR) ..... 02 00056

(51) Int. Cl.
*B09F 3/02* (2006.01)
*B42D 15/00* (2006.01)

(52) U.S. Cl. ..... 428/343; 428/915; 428/916; 283/72

(58) Field of Classification Search ..... 428/343, 428/915, 916; 283/72
See application file for complete search history.

(56) References Cited

U.S. PATENT DOCUMENTS 3,925,584 A * 12/1975 Suzuki et al. ..... 428/40.5
4,876,123 A * 10/1989 Rivera et al. ..... 428/34.2
5,629,093 A 5/1997 Bischof et al.

FOREIGN PATENT DOCUMENTS

| | | |
|---|---|---|
| DE | 34 31 239 | 7/1985 |
| EP | 0 461 337 A1 | 12/1991 |
| EP | 0 656 614 A2 | 6/1995 |
| WO | WO 93/13942 | 7/1993 |

* cited by examiner

*Primary Examiner*—Daniel Zirker
(74) *Attorney, Agent, or Firm*—Westerman, Hattori, Daniels & Adrian LLP

(57) ABSTRACT

The invention relates to a self-adhesive or heat-sealable security information medium designed to be applied to a page of a security document and to receive printing and/or writing, comprising an adhesive layer and at least one covering layer that covers the adhesive layer, characterized in that the cohesive strength of the covering layer is less than the adhesive strength of the adhesive layer.

The invention also relates to a method for the security protection of a page of a security document and to a security protection feature used in the security protection method.

The invention also relates to a page of a security document possessing said security protection feature and to a passport possessing said page.

19 Claims, 2 Drawing Sheets

SELF-ADHESIVE DATA CARRIER

The invention relates to a self-adhesive or heat-sealable information medium and more particularly to a self-adhesive medium that can be affixed to a document of value, especially a visa adhesively bonded to a page of a passport.

It also relates to a method for the security protection of a document or article and to the document or article thus security-protected.

At the present time, self-adhesive visas are produced using a paper of low grammage coated with an adhesive selected so that when attempts are made to remove the visa the passport paper on which the visa is affixed delaminates or else the visa paper itself tears.

However, in some cases counterfeiters are nevertheless successful in removing the visa from the passport and in subsequently reusing it, in two ways:

- either by managing to mechanically remove the visa without tearing it, by delaminating the passport paper only depthwise and then, on the back of the visa, abrading the paper passport particles that have remained attached to the visa;
- or by softening the adhesive forming the interface between the visa and the passport paper, using a heating tool such as a hotplate or a hairdryer.

The counterfeiters then merely have to reuse this visa in order to stick it into another passport.

To remedy the first problem posed, the Applicant proposes, during affixing of the visa, folding the latter over on itself so as to trap the edge of the page of a passport and also proposes preperforating the page of the passport in the area where the visa will be folded down, so as to create an area where there is direct adhesive/adhesive contact; thus, when an attempt is made to remove the visa mechanically, the visa paper will be more difficult to remove without preventing it from tearing.

Advantageously, with the means described above, to remedy the second problem posed, i.e. the removal of the visa using a heating tool, the Applicant proposes placing irreversible thermochromic reactants on the adhesive-coated visa, and preferably on the printed face of the visa; thus, when an attempt is made to remove the visa by heating it, an indelible color will appear on the printed face of the visa.

By virtue of the invention, the visa will indicate any attempt at forgery and therefore will no longer be reusable after attempts at mechanically and/or thermally removing it.

The invention, which may obviously be extended to any self-adhesive or heat-sealable security information medium, is not limited to visas; rather, it encompasses any relatively thin, flexible structure capable of serving as a printing or writing medium and intended to guarantee the authenticity of a document or an article; in particular, a label affixed to a package may be envisioned in this context.

The invention thus provides a self-adhesive or heat-sealable security information medium designed to be applied to a page of a security document and to receive printing and/or writing, comprising an adhesive layer and at least one covering layer that covers the adhesive layer, characterized in that the cohesive strength of the covering layer is less than the adhesive strength of the adhesive layer.

This means that, when an attempt is made to remove the adhesive medium, cleavage occurs within the covering layer and not in the adhesive layer.

According to one particular embodiment of the invention, the adhesive is also chosen so that the adhesive strength of the adhesive is greater than the cohesive strength of the page to which the adhesive medium is applied.

According to another particular embodiment of the invention, the self-adhesive or heat-sealable information medium includes irreversible thermochromic non-visible materials, having an irreversible coloration when an excessively large amount of heat is applied.

According to this same particular embodiment of the invention, the thermochromic materials change color irreversibly above about 70° C.

According to a preferred embodiment, the information medium constitutes a visa that can be affixed to a page of a passport.

Another object of the invention is to provide a method for the security protection of a page of a security document, in which:

- part of said page is perforated so as to form a holed area within the page, constituting a security protection feature;
- the holed area is covered using a self-adhesive information medium, so that the holed area is completely sandwiched between two facing adhesive areas of the information medium; and
- the facing adhesive areas are pressed together so as to create an inseparable bond, if a pull force greater than the adhesive strength of the adhesive is not applied.

According to one particular case, the self-adhesive information medium conforms to the self-adhesive or heat-sealable information medium defined above.

According to one particular case, a prior step of the method consists also in selecting the security protection feature on the basis of a security protection parameter specific to the holder of the document or article to be security-protected, especially on the basis of his age, nationality, eye or hair color, height, or on the basis of the date or place of the security protection.

According to one particular case, another prior step of the method consists in applying, in and/or on the surface of the self-adhesive information medium, non-visible materials that have irreversible thermochromic properties, so as to cause an irreversible coloration of said information medium when an excessively large amount of heat is applied.

In a preferred version of the previous method, thermochromic materials that change color irreversibly above about 70° C. are chosen.

In particular, the thermochromic materials are applied in and/or on the surface of the information medium either by applying an ink or a varnish having thermochromic properties, or by insertion of a thread, fibers or flakes containing said materials, or by mixing said materials with one of the constituents of the paper or of the adhesive.

Another object of the invention is to protect a security-protection feature used in the method described above, which possesses a sawtooth outline.

Specifically, the feature has the shape of a star, especially one with three or more points.

According to one particular embodiment, the feature consists of a series of Arab numerals or straight or oblique bars that can constitute a barcode.

A third object of the invention is to protect a page of a security document possessing said security protection feature.

According to one particular case, this page will be security-protected using the method as described above.

A final object of the invention is to protect a passport that includes a page as defined above.

The following description in conjunction with the appended drawings will make it more clearly understandable how the invention may be put into practice.

The appended figures relate to one particular embodiment of the visa affixed to a page of a passport, the relative proportions not being drawn to scale for the sake of clarity in the figures.

Figure 2:
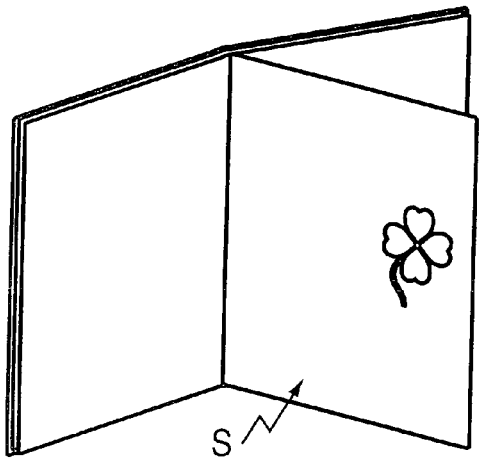
FIG. 2 is a perspective view of a passport, one of the pages of which has been preperforated before the corresponding visa has been affixed.
Figure 2A:
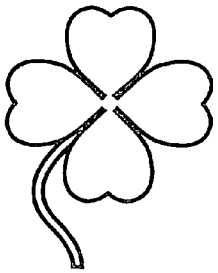
Figure 2B:
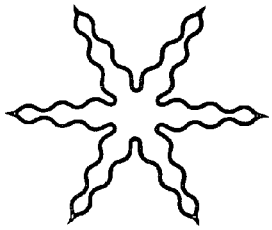
Figure 2C:
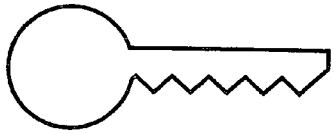

FIGS. 2A, 2B, and 2C show examples of security protection features.

Figure 3:
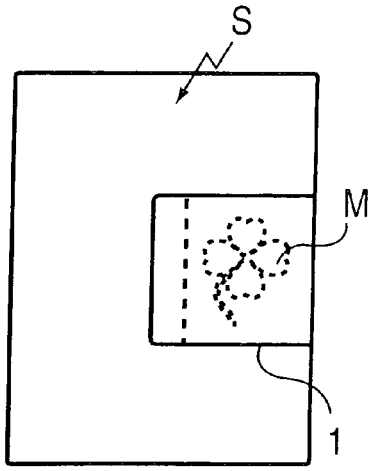

FIG. 3 shows that page of the passport that has been preperforated and covered with the corresponding visa.

Figure 4:
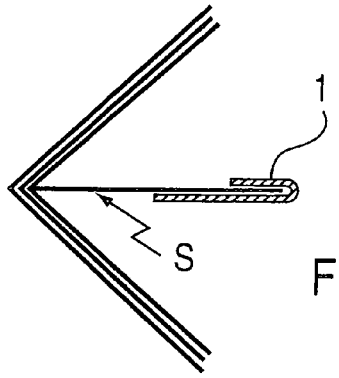

FIG. 4 shows the passport seen from above, with the passport page covered with its visa.

Figure 5:
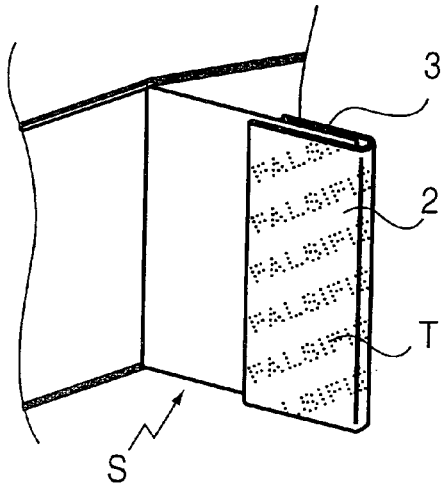

FIG. 5 shows the visa applied to the page of the passport, seen from above, with invisible printing comprising irreversible thermochromic reactants.

Figure 6:
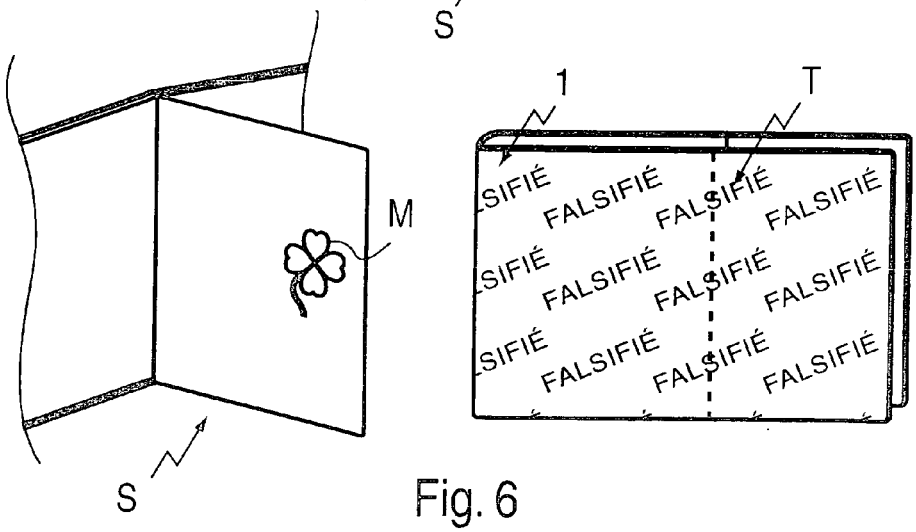

FIG. 6 shows, seen from above, the visa removed from the passport page after having been heated, with the thermochromic printing revealed.

Figure 1:
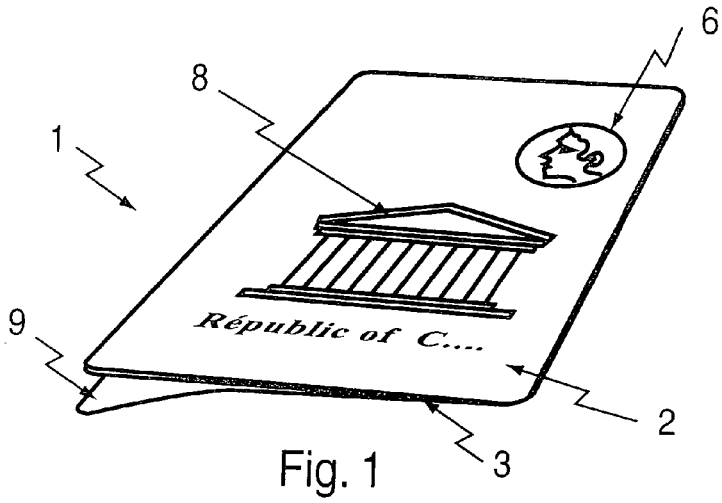
FIG. 1 is a perspective view of one embodiment of a self-adhesive or heat-sealable security information medium according to the invention.

The adhesive security information medium 1 according to the invention shown in FIG. 1 constitutes an adhesive visa designed to be affixed to a page S of a passport.

It comprises an adhesive layer 3, a covering layer 2 and a removable protective film 9 that covers the adhesive layer before it is bonded to a page S of a passport.

The covering layer 2 has, in the example described, a printed outer face 8 and a watermark 6.

The adhesive layer 3 preferably covers the entire surface of the covering layer 2 that is not intended for printing or writing.

According to the invention, the adhesive of the adhesive layer 3 is chosen so that the cohesive strength of the covering layer 2 is less than the adhesive strength of the adhesive layer 3.

In this way, by folding the visa 1 back on itself, part of the adhesive layer 3 will adhere to part of this same adhesive layer 3, and when a forger attempts to remove the visa it will be necessary to apply a pull force greater than the adhesive strength of the adhesive layer if he wishes to separate the two facing adhesive areas.

By choosing preferably a composition for the covering layer 2 that is formed essentially from natural and/or synthetic fibers and preferably results from a conventional papermaking process, so that the cohesive strength of this covering layer is less than the adhesive strength of the adhesive layer, a forger will necessarily impair the covering layer 2 if he wishes to completely detach the visa 1 that is folded on itself.

It is also possible to envision a covering layer 2 consisting of multilayers such that when removal is attempted one of the layers remains in contact with the adhesive layer 1, only the other layers being delaminated.

The preferred way of carrying out this lamination of the visa 1 on itself consists in fact in perforating the passport page S intended to receive the visa 1, preferably near one of its edges, as a security protection feature so as to create a holed area M through which the adhesive layer 3 of the visa applied to the obverse of said page will be brought into contact with the adhesive layer 3 of the same visa folded over onto the reverse of this page, as is apparent in FIG. 2.

The perforation may be made using a blanking die or using a laser.

The security protection feature may have three technical functions.

The first technical function of the security protection feature will be to allow the two adhesive areas of the visa that face each other to be brought into sufficient contact with each other to provide an adhesive strength between these two adhesive areas that is at least greater than the cohesive strength of the covering layer of this visa.

This means in fact avoiding security protection features that are too small, or too slender, for which the area of contact of the adhesive layers will be too restricted to allow durable and strong adhesion.

This area of contact may vary depending on the adhesives: an adhesive having a high adhesive strength will be compatible with a relatively thin or small area of contact.

The second function of the security protection feature will be to ensure that the document or article, in particular the passport, tears almost automatically, or at the very least quite easily, during fraudulant removal.

This is because, by suitably choosing the security protection feature, it will be possible to create areas of weakness in the document or article, where the attempt at removal will have a greater chance of resulting in impairment of the security protection feature and therefore of the document or article.

This will especially be the case if the security protection feature has slender and thin parts.

In this regard, the feature may have a series of regular or irregular curves, such as portions of circles, ellipses or sinusoids, and/or a series of straight, unaligned segments, and also any alternating combination of these curves and/or segments.

In particular, the feature used will have a sawtooth outline, at least two consecutive lines of which make an angle of less than 30°.

A typical example of such a feature is shown in FIG. 2A.

The feature thus shown represents one possible example of a four-leaf clover shape.

Another possible conceivable example of a feature is a general star shape with three or more points, in which preferably each point covers less than one third of the total surface of the security protection feature and more particularly less than 15% of the total surface of said feature.

The feature shown in FIG. 2B represents one possible example of a six-pointed star shape.

Other possible conceivable examples of features would be features representing animals or everyday objects shown in silhouette, as shown in FIG. 2C.

The last function of the security protection feature will be to encode certain security protection information to supplement the visa itself, which information will be readable either by holding the page of the passport covered with the visa up to the light, in the manner of a watermark, or readable electronically, the free space created in the page of the passport by the perforation feature making it possible to house, for example, an electronic chip without creating a detectable overthickness in the page.

This security protection feature may, for example, vary depending on the circumstances, or on the person requesting the visa.

Thus, an embassy will be able to modify the security protection feature according to the date or time the visa was affixed.

Each embassy will also have its own security protection features.

In the same way, this security protection feature may depend on the holder of the passport.

The feature will differ, for example, according to the age, nationality, sex, eye color, hair color and height of the person at the time of application for the visa.

It will also be possible to choose the fingerprint of the visa applicant as security protection feature, if necessary making it larger.

This list is not exhaustive and other parameters may be taken into account in choosing the feature.

In a preferred embodiment of the invention, the feature will be chosen randomly using a computer program or pseudo-randomly by entering certain data specific to the circumstances or to the person applying for a visa into the computer responsible for providing a feature in the form of a two-dimensional graphical representation of a mathematical function having as variable the above input data.

In this way, a forger, despite having being completely successful in removing the visa intact from its original passport, will without any doubt have no chance of having the same security protection feature as that present in the original passport.

The security protection feature that fulfills these three functions would in fact be a combination of parts that meet the first function mentioned and parts that meet the second function mentioned, the entire feature having a general shape that meets the third function mentioned.

In FIGS. 3 and 4 may be seen one possible example of the security protection of the passport of FIG. 1.

The folded-over part of the visa 1 must as far as possible be positioned in the extension of the nonfolded-over part of the visa so that the folded edge of the visa is applied flush against the straight edge of the page S of the passport.

The superposed areas of the two abovementioned parts of the visa will have to cover as much of the perforated area of the passport as possible.

In a preferred embodiment, it will be necessary to apply greater pressure, and for longer, on those parts of the visa, or of the self-adhesive information medium in general, covering the holed area of the passport, or of the article or document to be security-protected in general, so as to ensure a lasting bond that is not easily separable.

The adhesive security medium 1 according to the invention shown in FIG. 5 constitutes an adhesive visa that includes surface-printing made up of features, such as the word "forgery" printed repeatedly. This visa comprises an adhesive layer 3, a covering layer 2 and a removable protective film that covers the adhesive layer before bonding to the page S of the passport. Printing T was produced locally on the external face of the covering layer, by screen printing with an irreversible thermochromic ink, and this printing is invisible to the naked eye. Such a visa is designed to be affixed to a passport page after customization.

In FIG. 6, the visa 1 may be seen after that page S of the passport to which it was affixed has been removed, removal having been accomplished using a hotplate. Evidence of forgery may be seen on the visa removed by heat, thanks to the appearance in pink of the word "forgery", the pink color appearing above 70° C.

This temperature corresponds in fact to the temperature used by forgers to soften the acrylic-type adhesives used on self-adhesive visas for example.

Clearly, a person skilled in the art, in the light of the embodiments envisioned in the particular case of a visa adhesively bonded to a page of a passport, can extend the invention to any adhesive information medium applied to a document or article to be security-protected that has been preperforated using the method described above.

The invention claimed is:

1. A method for the security protection of a page of a security document, wherein part of said page is perforated so as to form a holed area within the page; said method comprising:

covering the holed area using a self-adhesive or heat-sealable information medium, so that the holed area is completely sandwiched between two facing adhesive areas of the information medium; and pressing the facing adhesive areas together so as to create an inseparable bond, if a pull force greater than the adhesive strength of the adhesive is not applied, wherein the self-adhesive or heat-sealable security information medium is designed to be applied to a page of a security document and to receive printing and/or writing, comprising an adhesive layer and at least one covering layer disposed on the adhesive layer, wherein the cohesive strength of the covering layer is less than the adhesive strength of the adhesive layer.

2. The method as claimed in claim 1, wherein the holed area within the page defines a security protection parameter specific to a holder of the document or article to be security-protected.

3. The method as claimed in claim 2, comprising a step of applying, in and/or on the surface of the self-adhesive information medium, non-visible materials that have irreversible thermoebromic properties, so as to cause an irreversible coloration of the information medium when an appropriate amount of heat is applied.

4. The method of claim 2, wherein the security protection parameter is defined on the basis of a feature selected from the group consisting of age, nationality, eye or hair color, height of the holder of the document, and date or place of the security protection, and combinations thereof.

5. The method as claimed in claim 1, comprising a step of applying, in and/or on the surface of the self-adhesive information medium, non-visible materials that have irreversible thermochromic properties, so as to cause an irreversible coloration of the information medium when an appropriate amount of heat is applied.

6. The method as claimed in claim 5, wherein thermochromic materials that change color irreversibly above about 70° C. are chosen.

7. The method as claimed in claim 6, wherein the thermochromic materials are applied in and/or on the surface of the information medium by a step selected from the group consisting of applying an ink or a varnish having thermochromic properties, inserting a thread, fibers or flakes containing said materials, or mixing said materials with one of the constituents of the medium or of the adhesive, and combinations thereof.

8. The method as claimed in claim 5, wherein the thermochromic materials are applied in and/or on the surface of the information medium by a step selected from the group consisting of applying an ink or a varnish having thermochromic properties, inserting a thread, fibers or flakes containing said materials, or mixing said materials with one of the constituents of the medium or of the adhesive, and combinations thereof.

9. The method of claim 5, wherein the holed area has a sawtooth outline.

10. A page of a security document obtained by the method as claimed in claim 9.

11. A passport that includes a page as claimed in claim 10.

12. The method of claim 1, wherein the holed area has the shape of a star.

13. The method of claim 12, wherein the holed area has the shape of a star with three or more points.

14. The method of claim 1, wherein the holed area consists of series of Arabic numerals or straight or oblique bars that can constitute a barcode.

15. A page of a security document obtained by the method of claim 1.

16. A passport that includes a page as claimed in claim 15.

17. The method of claim 1, wherein the cohesive strength of each of the at least one covering layer is less than the adhesive strength of the adhesive layer.

18. The method of claim 1, wherein the covering layer is formed essentially from natural and/or synthetic fibers.

19. The method of claim 18, wherein the covering layer results from a papermaking process.

* * * * *